US008758025B1

(12) United States Patent
Liljegren et al.

(10) Patent No.: US 8,758,025 B1
(45) Date of Patent: Jun. 24, 2014

(54) SYSTEMS AND METHODS FOR FACILITATING A CONNECTION

(75) Inventors: Edward A. Liljegren, San Francisco, CA (US); Sharon Morad, Palo Alto, CA (US); Nidhi Rathi, Sunnyvale, CA (US); Christopher T. Li, Mountain View, CA (US); Bryan D. Trinh, Sunnyvale, CA (US)

(73) Assignee: Amazon Technologies, Inc., Reno, NV (US)

( * ) Notice: Subject to any disclaimer, the term of this patent is extended or adjusted under 35 U.S.C. 154(b) by 0 days.

(21) Appl. No.: 13/608,861

(22) Filed: Sep. 10, 2012

(51) Int. Cl.
*H01R 11/30* (2006.01)

(52) U.S. Cl.
USPC ..... 439/39

(58) Field of Classification Search
USPC ..... 439/39
See application file for complete search history.

(56) References Cited

U.S. PATENT DOCUMENTS 4,609,238 A * 9/1986 Jamgotchian ..... 439/39
7,311,526 B2 * 12/2007 Rohrbach et al. ..... 439/39
7,419,378 B2 * 9/2008 Ha et al. ..... 439/39
7,625,213 B1 * 12/2009 Tse ..... 439/39
7,901,216 B2 * 3/2011 Rohrbach et al. ..... 439/39
2005/0255719 A1 * 11/2005 Heidlein ..... 439/39
2009/0182688 A1 * 7/2009 van der Zwan et al. ..... 705/500
2012/0143062 A1 * 6/2012 Nordgren et al. ..... 600/459
2013/0143419 A1 * 6/2013 Wei et al. ..... 439/39
2013/0164949 A1 * 6/2013 Riering-Czekalla et al. ... 439/39

* cited by examiner

*Primary Examiner* — Gary Paumen
(74) *Attorney, Agent, or Firm* — Sutherland Asbill & Brennan LLP

(57) ABSTRACT

A device includes one or more connectors and receptacles. The connector may include a pair of connector magnets. The connector may also include a pair of connector terminals positioned between the pair of connector magnets. The receptacle may be associated with a user device. The receptacle may include a pair of receptacle magnets that are configured to magnetically couple with the pair of connector magnets when brought within proximity of each other. The receptacle may also include a pair of receptacle terminals positioned between the pair of receptacle magnets that are configured to mate with the pair of connector terminals to form an electrical connection. In this manner, the connector and the receptacle may form an electrical connection when the pair of connector magnets is coupled with the pair of receptacle magnets, thereby mating the pair of connector terminals with the pair of receptacle terminals.

20 Claims, 10 Drawing Sheets

SYSTEMS AND METHODS FOR FACILITATING A CONNECTION

BACKGROUND

The rise in the popularity and use of user devices, such as tablets and smartphones, has led to significant improvements in the size and cost of these devices. The ever decreasing size of these devices provides increased mobility and usability; however, as these devices get smaller, limited space may be available for the attachment of accessories and/or power supplies.

BRIEF DESCRIPTION OF THE DRAWINGS

The detailed description is set forth with reference to the accompanying drawings. In the drawings, the left-most digit (s) of a reference numeral identifies the drawing in which the reference numeral first appears. The use of the same reference numerals indicates similar or identical items. Various embodiments may utilize elements and/or components other than those illustrated in the drawings and some elements and/or components may not be present in various embodiments. Throughout this disclosure, depending on the context, singular and plural terminology may be used interchangeably.

DETAILED DESCRIPTION

Figure 1:
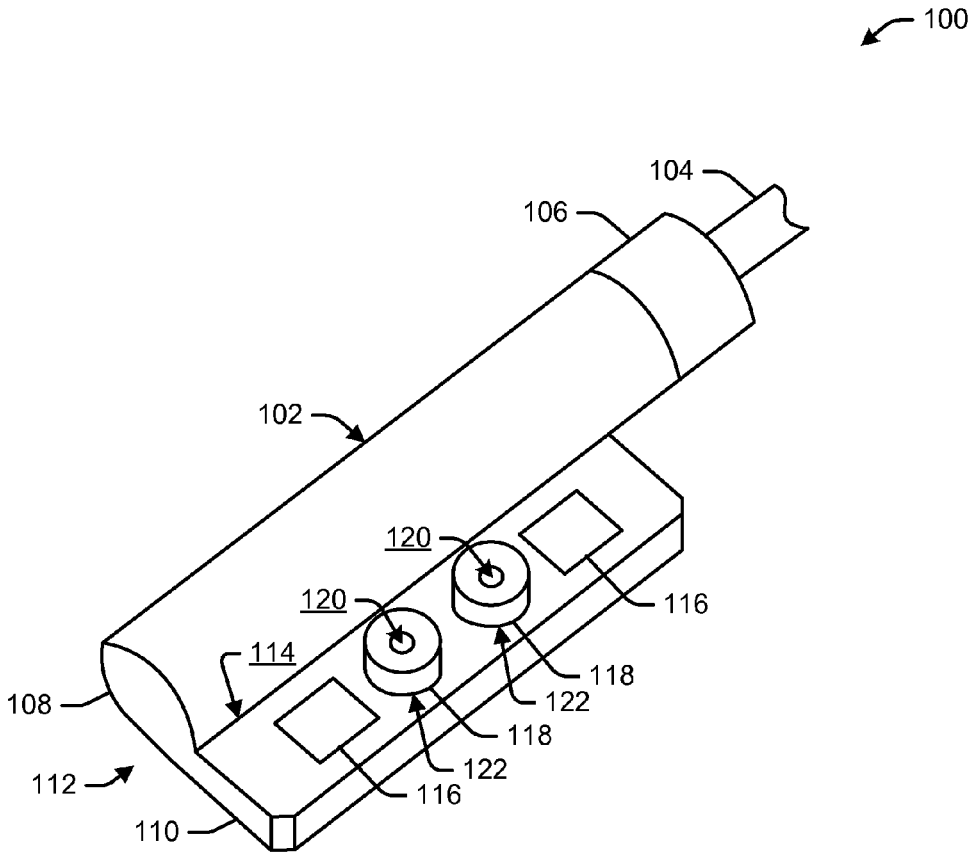
FIG. 1 schematically depicts an upper view of a front portion of an example connector in accordance with one or more embodiments of the disclosure.

User devices, such as mobile tablets and smartphones, have increased the speed and efficiency with which information is communicated and disseminated. By virtue of the pervasive mobile connectivity of such user devices, restrictions on the time and location of information sharing have largely been eliminated. However, as user devices become thinner and lighter, they tend to provide limited space for attachment points for coupling to other devices such as accessories. In particular, the sleek profile of many user devices provides limited space for the attachment of power supplies. A connector and a related receptacle are disclosed herein that utilize the limited space of the user devices to provide a connection. The connector and the receptacle disclosed herein also provide numerous other advantages relating to being able to form a connection with the user devices in various ways via the connector and the receptacle.

A connector is disclosed that may include a pair of connector magnets. The connector may also include a pair of connector terminals positioned such that each of the pair of connector terminals are between the pair of connector magnets. Also disclosed is a corresponding receptacle for a user device. The receptacle may include a pair of receptacle magnets that are configured to magnetically couple with the pair of connector magnets when brought within proximity of each other. The receptacle may also include a pair of receptacle terminals positioned such that each of the pair of receptacle terminals are between the pair of receptacle magnets that are configured to mate with the pair of connector terminals to form an electrical connection. In this manner, the connector and the receptacle may form an electrical connection when the pair of connector magnets is coupled with the pair of receptacle magnets, thereby mating the pair of connector terminals with the pair of receptacle terminals. Additionally, methods are disclosed for manufacturing, assembling, and/or providing the connector and the receptacle.

In one illustrative embodiment, the connector and the receptacle may facilitate creating an electrical connection between a power source and a user device. For example, the connector may include a connector body. In some instances, the connector body may be mechanically coupled to a cable that is electrically connected to a power source. A pair of connector magnets may be spaced apart from each other by a first distance and mechanically coupled within the connector body, and a pair of connector terminals may be positioned such that each of the pair of connector terminals is between the pair of connector magnets. The pair of connector terminals may be electrically connected to the power source via the cable. A connector backing plate may be magnetically coupled to the pair of connector magnets to conduct a magnetic field between the magnets and form a bridge between the pair of connector magnets. In some instances, the pair of connector magnets may be positioned at opposing ends of the connector backing plate.

The receptacle may be coupled to a user device. For example, the receptacle may include a pair of receptacle magnets positioned within the device and spaced apart from each other at a second distance about equal to the first distance between the connector magnets. Accordingly, the pair of receptacle magnets may be configured to magnetically couple with the pair of connector magnets when brought within proximity of each other. The receptacle may also include a pair of receptacle terminals positioned such that each of the pair of receptacle terminals are between the pair of receptacle magnets. The pair of receptacle terminals may be configured to mate with the pair of connector terminals to form an electrical connection. A receptacle backing plate may be attached to the pair of receptacle magnets to form a bridge between the pair of receptacle magnets. In some instances, the pair of receptacle magnets may be positioned at opposing ends of the receptacle backing plate in a similar fashion to the configuration of the connector backing plate and the pair of connector magnets discussed above. In this manner, the connector backing plate and the receptacle backing plate may be configured to collectively increase a magnetic coupling between the pair of connector magnets and the pair of receptacle magnets. For example, the connector backing plate and the receptacle backing plate may be configured to collectively conduct the magnetic flux of the pair of connector magnets and the pair of receptacle magnets to increase the magnetic coupling between them.

In certain embodiments, the pair of connector magnets and the pair of receptacle magnets may each include a predetermined polarization to prevent a user from improperly mating the pair of connector terminals with the pair of receptacle terminals. That is, the polarization of the pair of connector magnets and the pair of receptacle magnets may prevent (or at least provide an impediment to) attaching the connector to the receptacle in the wrong way. For example, the pair of connector magnets may include a North facing magnet spaced apart from a South facing magnet, and the pair of receptacle magnets may include a South facing magnet spaced apart from a North facing magnet. Such a configuration may force the connector to be attracted to the receptacle when in the correct orientation and repel the connector from the receptacle when in the incorrect orientation, thereby preventing the pair of connector terminals from mating with the pair of receptacle terminals in an incorrect manner that may lead to electrical failure.

In some instances, the connector backing plate and the receptacle backing plate may each be formed of a ferromagnetic material that is configured to conduct the magnetic flux of the pair of connector magnets and the pair of receptacle magnets. The ferromagnetic material exhibits ferromagnetic effects in its interaction with magnetic fields. The ferromagnetic material may contain iron, but in some implementations may not. For example, the connector backing plate and the receptacle backing plate may be a ferrous material (such as steel) or a non-ferrous material (such as one or more rare earth elements). Other materials, however, may also be used. Moreover, in other instances, the connector backing plate and the receptacle backing plate may each include a generally U-shaped (or horseshoe) configuration. For example, the generally U-shaped connector backing plate and the generally U-shaped receptacle backing plate, may in some instances, may collectively form a generally contiguous configuration, such as a closed-loop, circle, oval, rectangle, or the like, when the connector is mated with the receptacle. In one example, the generally circular configuration formed by the generally U-shaped connector backing plate and the generally U-shaped receptacle backing plate may conduct the magnetic fields of the pair of connector magnets and the pair of receptacle magnets to increase the magnetic coupling between them. The increased magnetic coupling may in turn increase a force required to disengage the connector from the receptacle. While specific examples of materials and configurations of the connector backing plate and the receptacle backing plate have been described, the connector backing plate and the receptacle backing plate may be any suitable material and/or configuration that is capable of influencing and/or manipulating the magnetic fields of the pair of connector magnets and the pair of receptacle magnets to increase a force required to disengage the connector from the receptacle.

These and other embodiments of the disclosure will be described in more detail through reference to the accompanying drawings in the detailed description that follows.

Illustrative Embodiments

Figure 2:
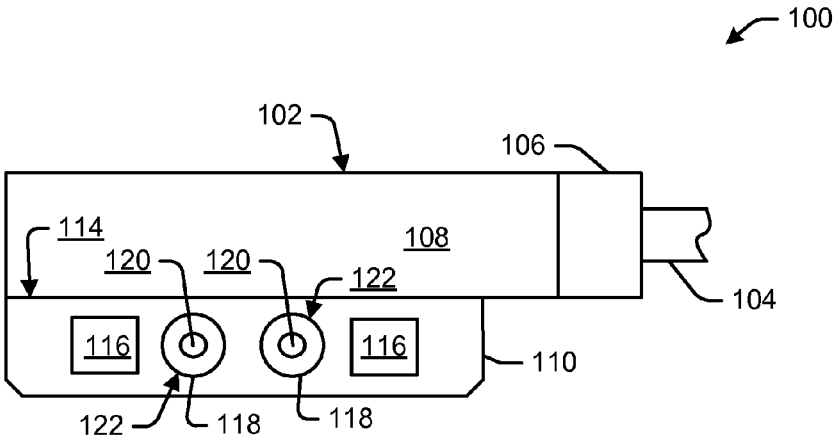
FIG. 2 schematically depicts a top view of the example connector of FIG. 1 in accordance with one or more embodiments of the disclosure.
Figure 3:
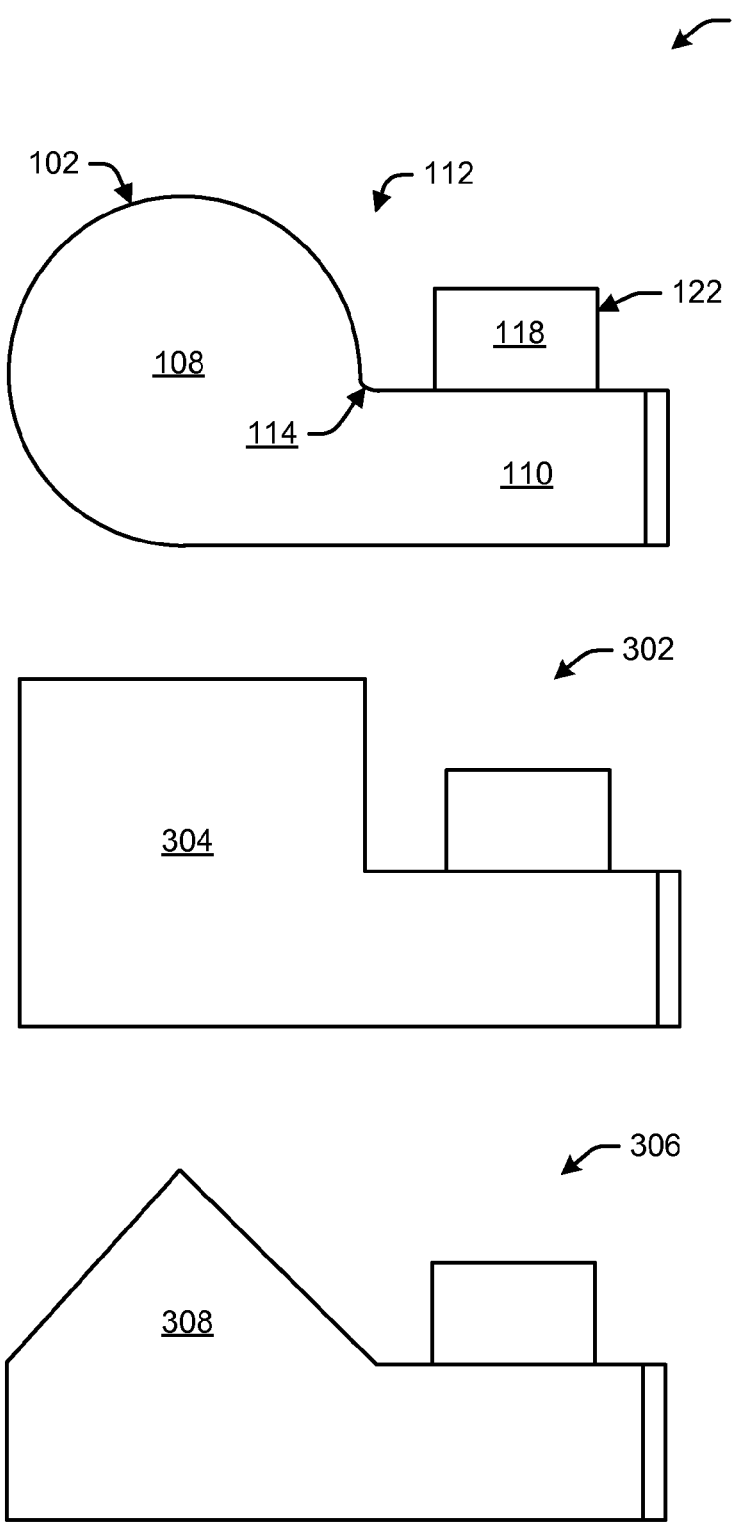
FIG. 3 schematically depicts a number of side views of the example connector of FIG. 1 in accordance with one or more embodiments of the disclosure.
Figure 4:
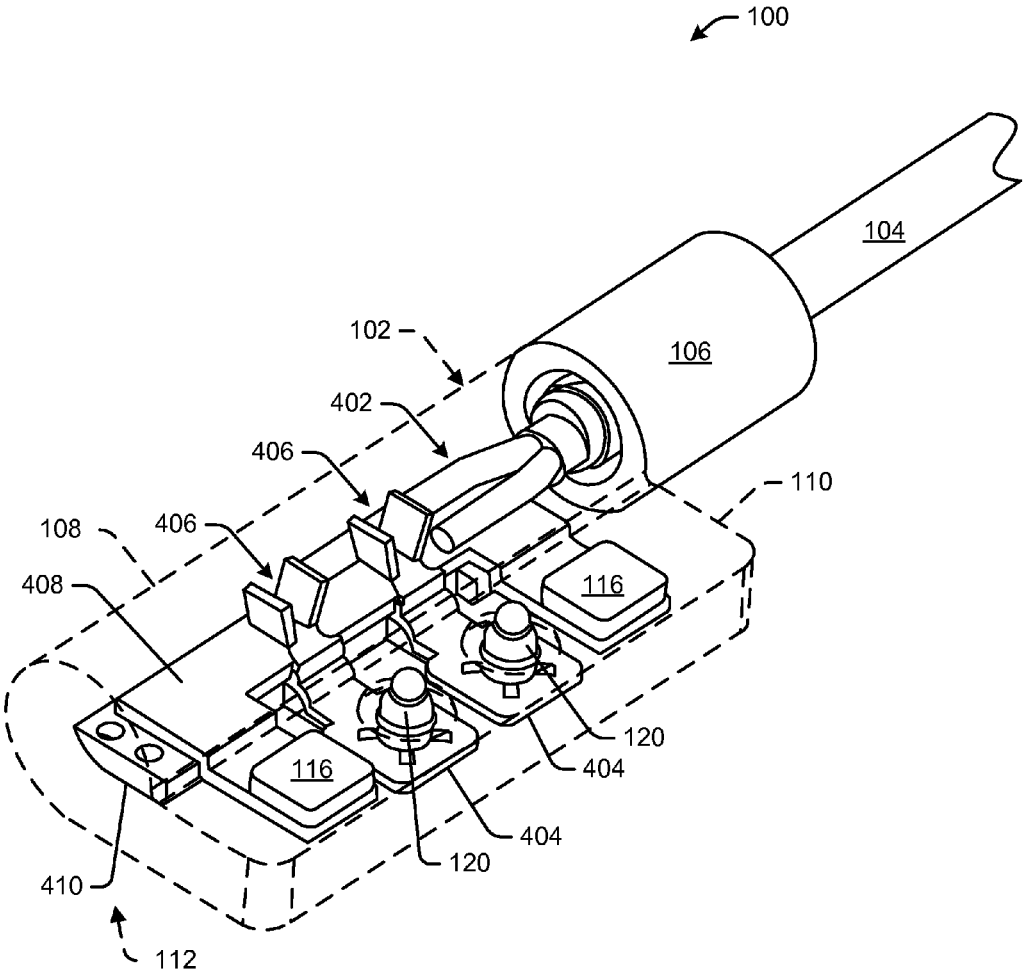
FIG. 4 schematically depicts an upper view of a front portion of the example connector of FIG. 1 with the connector body depicted in phantom lines to provide an internal view of the connector in accordance with one or more embodiments of the disclosure.

FIGS. 1-4 schematically depict various views of a connector 100 in accordance with an embodiment of the disclosure. Specifically, FIG. 1 schematically depicts an upper view of a front portion of the connector 100, FIG. 2 schematically depicts a top view of a front portion of the connector 100, FIG. 3 schematically depicts various side views of a portion of the connector 100, and FIG. 4 schematically depicts an upper view of a front portion of the connector 100 with a portion of the connector 100 depicted in phantom lines to provide an internal view of the connector 100. Collectively referring to FIGS. 1-4, and by way of example, the connector 100 may include a connector body 102 mechanically coupled to a cable 104, such as, but not limited to, a coaxial cable, a flat cable, or the like.

In some examples, the connector body 102 may be mechanically coupled to the cable 104 by way of a strain relief device 106. That is, the strain relief device 106 may be positioned between the connector body 102 and the cable 104. In some instances, the strain relief device 106 may hold the cable 104 steady relative to the connector body 102 and/or compensate for tension applied to the cable 104 to prevent the cable 104 or a portion thereof from becoming decoupled with the connector body 102. Any number and/or configuration of strain relief devices 106 may be used herein. While the connector body 102 is depicted as being mechanically coupled with the cable 104 via the strain relief device 106, in certain embodiments the connector body 102 may be directly coupled with the cable 104 and the strain relief device 106 may be omitted. In other embodiments, the strain relief device 106 may be integral to the connector body 102. That is, in some instances, the strain relief device 106 and the connector body 102 may be combined into a single component. Further, while the connector body 102 is depicted as being associated with the cable 104, in some embodiments the connector body 102 may equally be associated with wireless hardware and software such that the cable 104 may be omitted. For example, the connector 100 may be used as a data transfer device instead of a power device. In such instances, the connector 100 may be used to attach a wireless accessory to a user device. That is, in some examples, the connector body 102 may be associated with one or more receivers, transmitters, and/or transceivers for providing a wireless connection.

In one illustrative embodiment, the connector 100 may include a connector body 102 having an elongated circular or arcuate portion 108 extending along a length of the connector body 102. The connector body 102 may also include an elongated platform portion 110 positioned adjacent to the elongated circular portion 108. The elongated platform portion 110 may extend at least partially along a length of the elongated circular portion 108 such that the elongated circular portion 108 and the elongated platform portion 110 may collectively form a generally P-shaped cross-section 112 extending at least partially along the length of the connector body 102. In this manner, the generally P-shaped cross-section 112 may provide a convenient configuration that a user may grasp. Moreover, in certain embodiments, the generally P-shaped cross-section 112 may impede a user from positioning the connector body 102 in direct abutting engagement with an unintended magnetic device, such as a magnetic strip associated with a credit card or the like. Accordingly, the generally P-shaped cross-section 112 may impede the pair of connector magnets 116 from coupling with an unintended magnetic device.

In addition, in certain embodiments, the generally P-shaped cross-section 112 may form a lip 114 at the junction between the elongated platform portion 110 and the elongated circular portion 108, which may guide a user in positioning the connector 100 properly along an edge of a user device. In some instances, the connector body 102 may be a single uni-body piece of material and/or a combination of pieces affixed together. While the connector body 102 is depicted as including an elongated circular portion 108 and an elongated platform portion 110, in certain embodiments the connector body 102 may be any configuration and may include additional portions.

In certain embodiments, the connector body 102 may include a pair of connector magnets 116 positioned therein. For example, the pair of connector magnets 116 may be positioned, at least partially, within the elongated platform portion 110, the elongated circular portion 108, or a combination thereof. In some instances, a surface of each of the pair of connector magnets 116 may be positioned flush with a surface of the elongated platform portion 110. In other instances, however, a surface of each of the pair of connector magnets 116 may project from a surface of the elongated platform portion 110. In another instance, a surface of each of the pair of connector magnets 116 may be recessed within a surface of the elongated platform portion 110. In still other instances, a surface of each of the pair of connector magnets 116 may be wholly disposed within the elongated platform portion 110 such that the pair of connector magnets 116 may not be visible from outside of the connector body 102.

In some examples, the pair of connector magnets 116 may be spaced apart from each other by a first distance along the connector body 102. For example, the pair of connector magnets 116 may be spaced apart along the elongated platform portion 110. It should be appreciated, however, that the pair of connector magnets 116 may be spaced apart along the connector body 102 in any orientation. For example, the pair of connector magnets 116 may be spaced apart along the connector body 102 in an alignment generally parallel to a length of the connector body 102. In another embodiment, the pair of connector magnets 116 may be spaced apart along the connector body 102 in an alignment generally perpendicular to a length of the connector body 102. Further, the pair of connector magnets 116 may be spaced apart along the connector body 102 in any alignment or at any angle relative to the length of the connector body 102. In some instances, the pair of connector magnets 116 may be positioned along the elongated platform portion 110, the elongated circular portion 108, or a combination thereof. While the connector body 102 is depicted as including a pair of connector magnets 116, in certain embodiments only a single magnet may be used. Further, while the connector body 102 is depicted as including a pair of connector magnets 116, in certain embodiments the connector body 102 or a portion thereof may be magnetic and the pair of connector magnets 116 may be omitted.

In one embodiment, a pair of connector terminals 118 may be positioned such that each of the pair of connector terminals 118 are between the pair of connector magnets 116. For example, the pair of connector terminals 118 may be positioned between the pair of connector magnets 116 along a surface of the elongated platform portion 110. In some examples, the pair of connector terminals 118 may be positioned in line with the pair of connector magnets 116. That is, in some instances, the pair of connector terminals 118 and the pair of connector magnets 116 may share a common centerline. In other instances, the pair of connector terminals 118 may be positioned in an offset alignment between the pair of connector magnets 116, i.e., they may not share a centerline. In addition, in certain embodiments, the pair of connector terminals 118 may project from a surface of the connector body 102. For example, in one embodiment, the pair of connector terminals 118 may be positioned such that each of the pair of connector terminals 118 are between the pair of connector magnets 116 on the elongated platform portion 110 such that the pair of connector terminals 118 extend in a generally transverse direction from a surface of the elongated platform portion 110. While the pair of connector terminals 118 is depicted as protruding from a surface of the connector body 102, in certain embodiments the pair of connector terminals 118 may be recessed within a surface of the connector body 102, positioned flush with a surface of the connector body 102, raised from a surface of the connector body 102, or a combination thereof. Further, while the pair of connector terminals 118 is depicted as being positioned such that each of the pair of connector terminals 118 is between the pair of connector magnets 116, in some embodiments the pair of connector terminals 118 may be positioned outside of the pair of connector terminals 118. Moreover, in some instances, the pair of connector terminals 118 may comprise a single terminal positioned such that each of the pair of connector terminals 118 is between or outside of the pair of connector magnets 116.

In certain embodiments, each of the pair of connector terminals 118 may include a spring loaded terminal 120 configured to apply a force to a corresponding receptacle terminal as will be discussed in greater detail below. For example, each of the pair of connector terminals 118 may include a spring loaded terminal 120. The spring loaded terminal 120 may include, but is not limited to, a POGO® pin manufactured by Everett Charles Technologies of Pomona, Calif. In addition, in other embodiments, each of the pair of connector terminals may include a shroud 122. For example, the shroud 122 may be positioned around each of the spring loaded terminals 120. In some instances, the shroud 122 may include a nonconductive material, such as a hard piece of plastic or the like, that protects the spring loaded terminals 120. In one embodiment, each of the pair of spring loaded terminals 120 may be at least partially recessed within the shroud 122 to prevent an inadvertent connection between the pair of spring loaded terminals 120 and a foreign object, such as a paper clip or the like, which may create a short. In some instances, the connector terminals 118 may be magnetic. For example, the spring loaded terminals 120, the shrouds 122 surrounding the spring loaded terminals 120, or a combination thereof may be magnetic. In such instances, the pair of connector magnets 116 may be omitted because the connector terminals 118 may provide the means for forming a magnetic coupling with a user device.

While the connector 100 is depicted as including a connector body 102 having a generally P-shaped cross section 112, in certain embodiments, as depicted in FIG. 3, the connector 100 may also include other cross-sectional configurations that may impede the pair of connector magnets 116 from coupling with an unintended magnetic device. For example, the connector 100 may include connector body 302, which includes an elongated rectangular portion 304. Further, the connector 100 may include connector body 306, which includes an elongated triangular portion 308. Any configuration of the connector 100 may be used herein. In some instances, the pair of connector terminals 118 may be mechanically coupled and electrically connected to the cable 104 for supplying power to the pair of connector terminals 118. For example, the cable 104 may include a coaxial wire 402. In addition, the pair of connector terminals 118 may each include a connector terminal platform 404 mechanically coupled and electrically connected to a connector terminal clamp 406, with each of the spring loaded terminals 120 being attached to a respective connector terminal platform 404. In this manner, in certain embodiments, the coaxial wire 402 may be connected to the spring loaded terminals 120 via the connector terminal clamps 406. For example, the positive and negative wires of the coaxial wire 402 may be attached to the pair of connector terminals 118, respectively, via the connector terminal clamps 406 so as to facilitate an electrical connection between the spring loaded terminals 120 and the cable 104. In this manner, in certain embodiments, the spring loaded terminals 120 may be configured to supply power to a user device (such as user device 602 of FIGS. 6 and 7) when associated therewith.

In one illustrative embodiment, the connector 100 may include a connector backing plate 408. The connector backing plate 408 may be magnetically coupled to the pair of connector magnets 116 to form a bridge between the pair of connector magnets 116. The connector backing plate 408 may be mechanically coupled to the connector magnets 116 as well. For example, an adhesive may be used to mechanically join the connector backing plate 408 to the connector magnets 116.

In some embodiments, the pair of connector magnets 116 may be positioned at opposing ends of the connector backing plate 408. In other embodiments, the connector backing plate 408 may be formed of a ferromagnetic material and include a generally U-shaped configuration. In certain embodiments, the connector backing plate 408 may be configured to conduct a magnetic field of the pair of connector magnets 116. In some instances, the connector backing plate 408, the pair of connector magnets 116, the pair of connector terminals 118, the cable 104, and/or various other components of the connector 100 may be supported directly or indirectly within the connector body 102 by a support plate 410. The support plate 421 may be any size and/or configuration necessary to provide support for the aforementioned components. For example, the support plate 410 may include any number of recesses and/or protrusions to ensure that the various components of the connector 100 are maintained in one or more predetermined locations and/or orientations.

Figure 5:
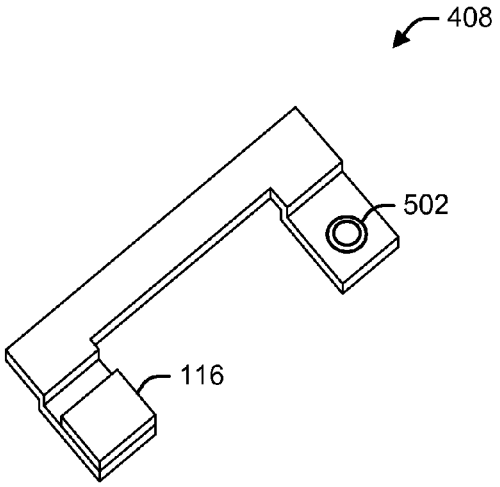
FIG. 5 schematically depicts an upper view of a front portion of an example connector backing plate with one of the associated pair of connector magnets omitted for illustration of a channel in accordance with one or more embodiments of the disclosure.

Turning now to FIG. 5, which schematically depicts an upper view of a front portion of the connector backing plate 408 and one of the associated pair of connector magnets 116 omitted for illustration of a channel 502 in accordance with an embodiment of the disclosure. In some instances, in order to provide for the greatest amount of contact between the connector backing plate 408 and the attached pair of connector magnets 116, a surface of the connector backing plate 408 in contact with each of the pair of connector magnets 116 may include a channel 502 configured to receive an adhesive for affixing each of the pair of connector magnets 116 to the connector backing plate 408. In this manner, the pair of connector magnets 116 may be attached to the connector backing plate 408 without forming a layer of adhesive between each of the pair of connector magnets 116 and the connector backing plate 408. Instead, the adhesive layer between each of the pair of connector magnets 116 and the connector backing plate 408 may be limited to the area near the channel 502. Such a configuration increases the influence that the connector backing plate 408 has on conducting the magnetic flux of each of the pair of connector magnets 116 due to the increased direct contact between the connector backing plate 408 and each of the pair of connector magnets 116.

Figure 6:
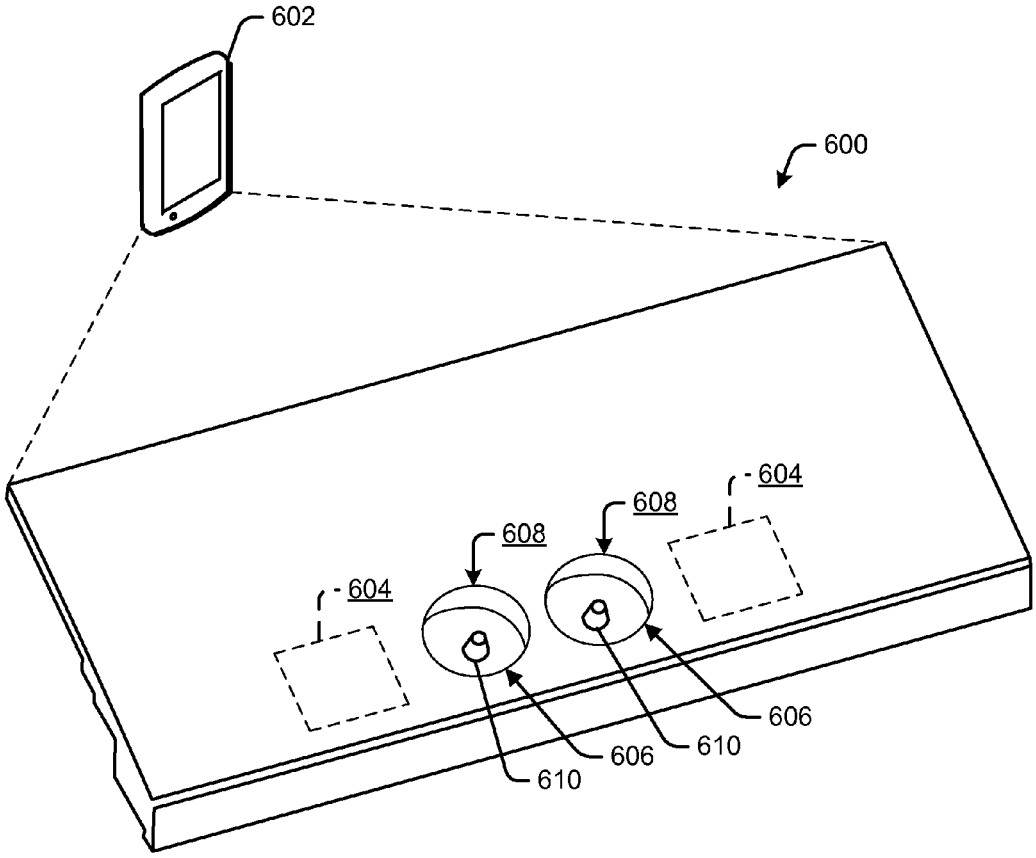
FIG. 6 schematically depicts an upper view of a front portion of an example receptacle in accordance with one or more embodiments of the disclosure.
Figure 7:
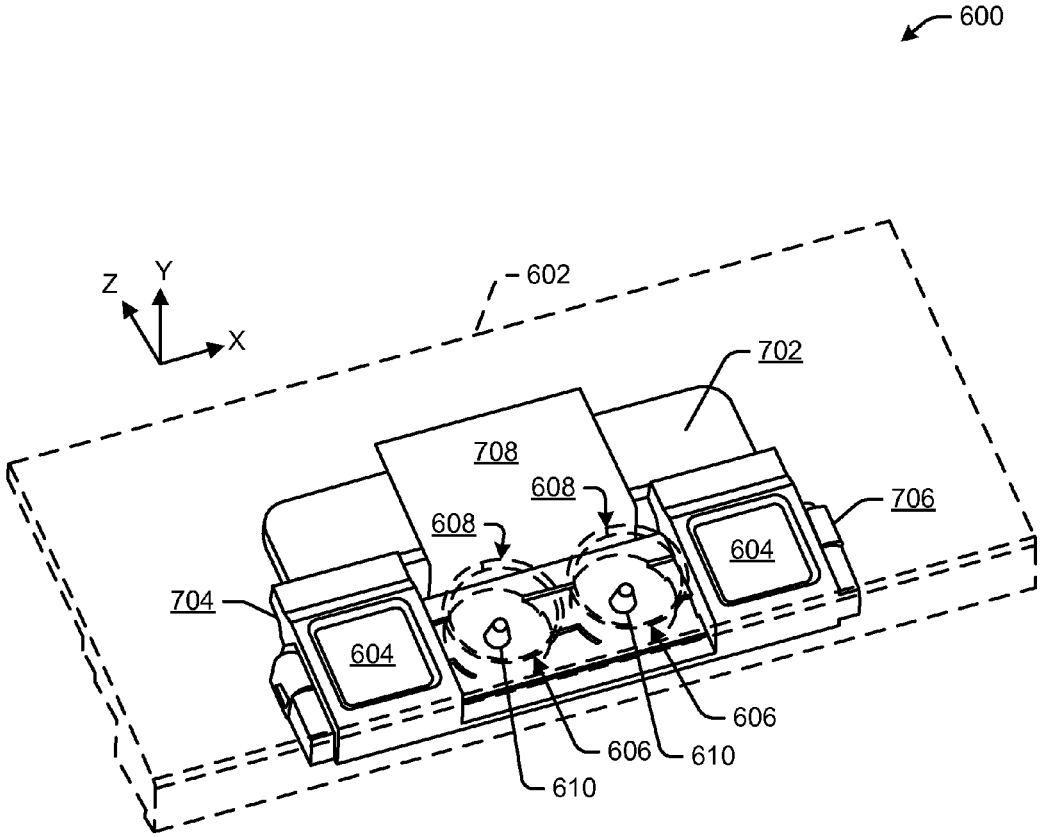
FIG. 7 schematically depicts an upper view of a front portion of the example receptacle of FIG. 6 with the user device depicted in phantom lines to provide an internal view of the receptacle in accordance with one or more embodiments of the disclosure.
Figure 8:
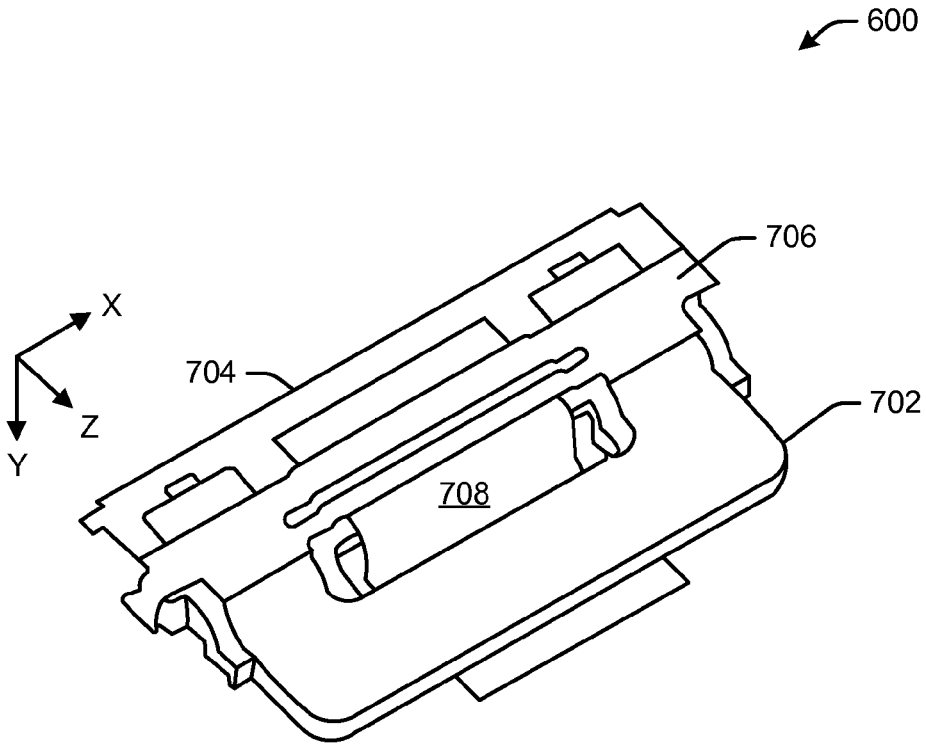
FIG. 8 schematically depicts an upper view of a back portion of the example receptacle of FIG. 7 in accordance with one or more embodiments of the disclosure.

FIGS. 6-8 schematically depict various views of a receptacle 600 in accordance with an embodiment of the disclosure. Specifically, FIG. 6 schematically depicts an upper view of a front portion of the receptacle 600, FIG. 7 schematically depicts an upper view of a front portion of the receptacle 600 with a portion of the user device 602 depicted in phantom lines to provide an internal view of the receptacle 600, and FIG. 8 schematically depicts an upper view of a back portion of the receptacle 600. Collectively referring to FIGS. 6-8, and by way of example, the receptacle 600 may be coupled to a user device 602. The user device 602 may be any number of user devices, such as, but not limited to, tablets, smartphones, laptops, or the like.

In one illustrative embodiment, the receptacle 600 may include a pair of receptacle magnets 604 positioned about the user device 602. For example, the pair of receptacle magnets 604 may be positioned, at least partially, within the user device 602. In some instances, a surface of each of the pair of receptacle magnets 604 may be positioned flush with a surface of the user device 602. In other instances, a surface of each of the pair of receptacle magnets 604 may project from a surface of the user device 602. In another instance, a surface of each of the pair of receptacle magnets 604 may be recessed within a surface of the user device 602. In still other instances, a surface of each of the pair of receptacle magnets 604 may be wholly disposed within the user device 602 such that the pair of receptacle magnets 604 are not visible from outside of the user device 602. In addition, the pair of receptacle magnets 604 may be spaced apart from each other by a second distance about equal to the pair of corresponding connector magnets 116 of the connector 100. The pair of receptacle magnets 604 and the pair of corresponding connector magnets 116, however, may be arranged in any manner to magnetically couple with one another. For example, the pair of receptacle magnets 604 and the pair of corresponding connector magnets 116 may be configured to at least partially overlap with one another when coupled together. In other instances, the pair of receptacle magnets 604 and the pair of corresponding connector magnets 116 may not overlap when coupled together.

In some instances, each of the pair of receptacle magnets 604 may include a surface area about equal to a surface area of a corresponding connector magnet 116 of the connector 100. The connector magnets 116 and the receptacle magnets 604 have faces or surfaces which correspond or are presented to one another during mating of the connector. The surface area of these faces may be about equal. For example, if a connector magnet 116 has an exterior face with a surface area of about 9 millimeters square, the receptacle magnet 604 may have an exterior face with a surface area of about 9 millimeters square. These faces may have the same shape or complementary shapes. In this manner, the pair of receptacle magnets 604 may be configured to magnetically couple with the pair of connector magnets 116 when brought within proximity of each other.

In one illustrative embodiment, a pair of receptacle terminals 606 may be positioned such that each of the pair of receptacle terminals 606 are between the pair of receptacle magnets 604. For example, the pair of receptacle terminals 606 may be positioned between the pair of receptacle magnets 604 along a surface of the user device 602. In some examples, the pair of receptacle terminals 606 may be positioned in alignment with the pair of receptacle magnets 604. That is, in some instances, the pair of receptacle terminals 606 and the pair of receptacle magnets 604 may share a common centerline. In other instances, the pair of receptacle terminals 606 may be positioned in an offset alignment between the pair of receptacle magnets 604. That is, in some instances, the pair of receptacle terminals 606 and the pair of receptacle magnets 604 may not share a common centerline.

In certain embodiments, each of the pair of receptacle terminals 606 may include a recess 608. For example, each of the pair of receptacle terminals 606 may be recessed below a surface of the user device 602. In some examples, the recess 608 may be configured to mate with a corresponding shroud 122 of the connector terminals 118. In this manner, when the connector terminals 118 are mated with the receptacle terminals 606, the shrouds 122 of the connector terminals 118 may be positioned within the recesses 608 of the receptacle terminals 606. Moreover, in other examples, each of the pair of receptacle terminals 606 may include a pin 610 positioned within the recess 608. Pads or other electrical components configured to create an electrical connection may also be positioned within the recess 608. In this manner, when the connector terminals 118 are mated with the receptacle terminals 606 such that the shrouds 122 of the connector terminals 118 are positioned within the recesses 608 of the receptacle terminals 606, the spring loaded terminals 120 of the connector terminals 118 may contact the pins 610 of the receptacle terminals 606 to create an electrical connection. For example, in some instances, the pins 610 may extend at least partially into the recess of the shroud 122 to contact the spring loaded terminals 120 positioned therein. In this manner, the spring loaded terminals 120 may be configured to provide a force against the pins 610 of the receptacle terminals 606, thereby tending to ensure a constant electrical connection between the connector terminals 118 and the receptacle terminals 606. In some instances, the receptacle terminals 606 may be magnetic. For example, the recesses 608, the pins 610, or a combination thereof may be magnetic. In such instances, the pair of receptacle magnets 604 may be omitted because the receptacle terminals 606 may provide the means for forming a magnetic coupling with the connector 100.

While the pair of receptacle terminals 606 is depicted as recessed within from a surface of the user device 602, in certain embodiments the pair of receptacle terminals 606 may be positioned flush with a surface of the user device 602, raised from a surface of the user device 602, recessed within a surface of the user device 602, or a combination thereof. Further, while the pair of receptacle terminals 606 is depicted as being positioned such that each of the pair of receptacle terminals 606 is between the pair of receptacle magnets 604, in some embodiments the pair of receptacle terminals 606 may be positioned outside of the pair of receptacle magnets 604. Moreover, in some instances, the pair of receptacle terminals 606 may comprise a single terminal positioned between or outside of the pair of receptacle magnets 604. Still further, while the receptacle 600 is depicted as including a pair of receptacle magnets 604, in certain embodiments only a single magnet may be used.

In one illustrative embodiment, the receptacle 600 may include a receptacle backing plate 702, as shown in FIG. 7. The receptacle backing plate 702 may be attached to the pair of receptacle magnets 604 to form a bridge between the pair of receptacle magnets 604. In some embodiments, the pair of receptacle magnets 604 may be positioned at opposing ends of the receptacle backing plate 702. In other embodiments, the receptacle backing plate 702 may be formed of a ferromagnetic material and may include a generally U-shaped configuration. In certain embodiments, the receptacle backing plate 702 may be configured to conduct a magnetic field of the pair of receptacle magnets 604. In other embodiments, the receptacle backing plate 702 may include a channel configured to receive an adhesive for affixing each of the pair of receptacle magnets 604 to the receptacle backing plate 702 in a similar fashion as previously described with regard to the connector backing plate 408 in FIG. 5.

In some instances, the receptacle backing plate 702, the pair of receptacle terminals 606, and various other components of the receptacle 600 may be supported directly or indirectly within the user device 602 by a housing 704 and/or a retention plate 706. For example, the receptacle backing plate 702 and the pair of receptacle terminals 606 may be positioned, at least partially, within the housing 704, with the retention plate 706 maintaining the receptacle backing plate 702 and the pair of receptacle terminals 606 within the housing 704. The housing 704 and the retention plate 706 may be any size or configuration necessary to provide support for the aforementioned components. For example, the housing 704 and the retention plate 706 may include any number of recesses or protrusions to ensure that the various components of the receptacle 600 are maintained in one or more predetermined locations or orientations. In certain embodiments, a flex plate 708 may be attached to the pair of receptacle terminals 606. For example, the flex plate 708 may be positioned between the housing 704 and the receptacle backing plate 702 and may include a generally Z-shaped piece of resilient material. The flex plate 708 may be configured to support the receptacle terminals 606, such as the pins 610 disposed within the recesses 608. That is, the flex plate 708 may provide for a minimal amount of "give" or supply a counteractive force when pressure is applied to the pins 610.

In certain embodiments, the pair of connector magnets 116 and the pair of receptacle magnets 604 may each include a predetermined polarization to prevent (or impede) a user from improperly mating the pair of connector terminals 118 with the pair of receptacle terminals 606. In some instances, the pair of connector magnets 116 may include a North facing magnet spaced apart from a South facing magnet. Conversely, the pair of receptacle magnets 604 may include a South facing magnet spaced apart from a North facing magnet. The orientation of the North and South facing magnets in both the connector 100 and the receptacle 600 may be predetermined to ensure that the connector 100 and the receptacle 600 are incapable of being coupled the wrong way. For example, a predetermined polarization of the magnets in both the connector 100 and the receptacle 600 may force the connector 100 to be attracted to the receptacle 600 when it is coupled in the correct orientation with the receptacle 600. On the other hand, the predetermined polarization of the magnets in both the connector 100 and the receptacle 600 may force the connector 100 to be repelled from the receptacle 600 when an attempt is made to couple them incorrectly.

In some instances, the connector backing plate 408 and the receptacle backing plate 702 may each be formed of a ferromagnetic material that is configured to conduct the magnetic flux of the pair of connector magnets 116 and the pair of receptacle magnets 604. For example, the connector backing plate 408 and the receptacle backing plate 702 may each be formed of a ferromagnetic material, such as a material comprising a high iron content and a low carbon content. In other instances, the connector backing plate 408 and the receptacle backing plate 702 may be formed of a non-ferrous material, such as the rare earth elements. For example, the connector backing plate 408 and the receptacle backing plate 702 may be formed of a non-ferromagnetic material, a plastic, a ceramic, a composite, or a combination thereof that is configured to conduct a magnetic flux of the pair of connector magnets and the pair of receptacle magnets. Moreover, in certain embodiments, the connector backing plate 408 and the receptacle backing plate 702 may each include a generally U-shaped (or horseshoe) configuration. For example, the generally U-shaped connector backing plate 408 and the generally U-shaped receptacle backing plate 702 may, in some instances, collectively form a generally circular configuration when the connector 100 is mated with the receptacle 600. In some instances, the generally circular configuration formed by the generally U-shaped connector backing plate 408 and the generally U-shaped receptacle backing plate 702 may conduct the magnetic fields of the pair of connector magnets 116 and the pair of receptacle magnets 604 to increase the magnetic coupling between them. The increased magnetic coupling may in turn increase a force required to disengage the connector 100 from the receptacle 600. While specific examples of materials and configurations of the connector backing plate 408 and the receptacle backing plate 702 have been described, the connector backing plate 408 and the receptacle backing plate 702 may be any suitable material and/or configuration that is capable of manipulating the magnetic fields of the pair of connector magnets 116 and the pair of receptacle magnets 604 to increase a force required to disengage the connector 100 from the receptacle 600.

Illustrative Methods

Figure 9:
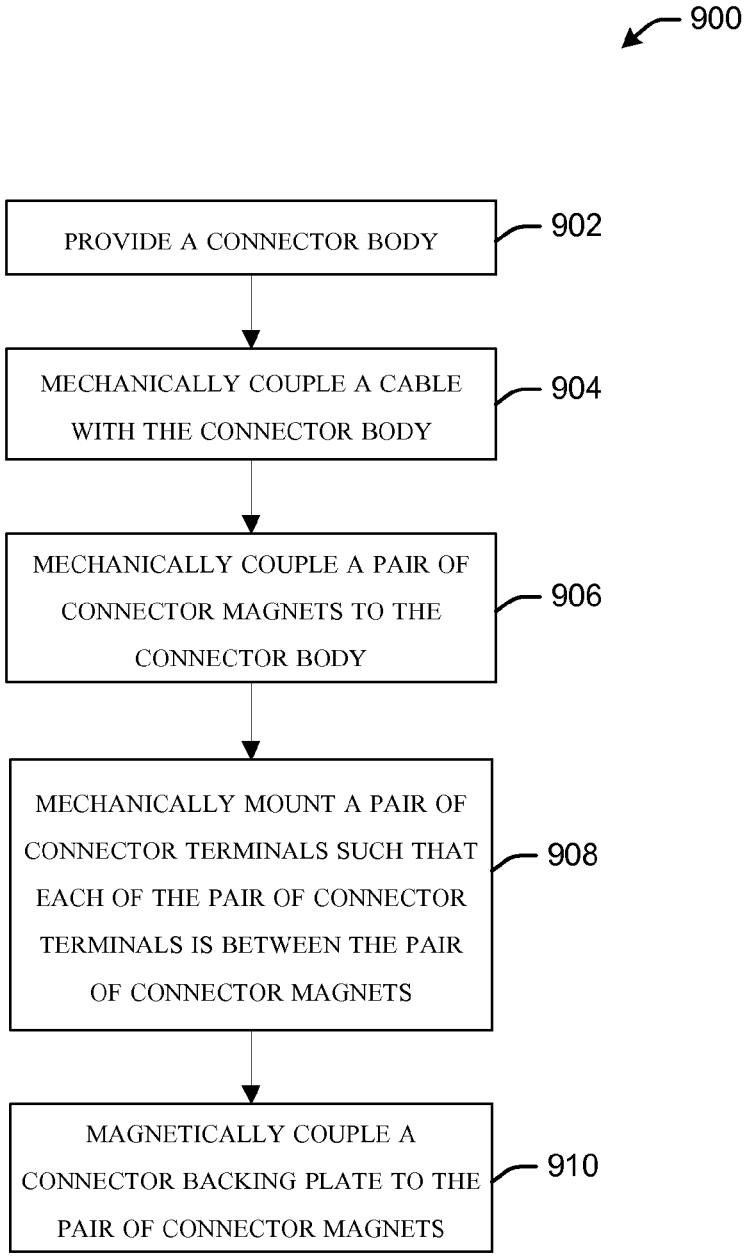
FIG. 9 is a flow diagram depicting an illustrative method for providing a connector in accordance with one or more embodiments of the disclosure.

FIG. 9 is a flow diagram depicting an illustrative method 900 for providing the connector 100 in accordance with one or more embodiments of the disclosure.

At block 902 of method 900, a connector body 102 may be provided. That is, in one embodiment, the connector body 102 may be manufactured to include, for example, a connector body 102 having an elongated circular portion 108 extending along a length of the connector body 102. The connector body 102 may also include an elongated platform portion 110 positioned adjacent to the elongated circular portion 108. The elongated platform portion 110 may extend at least partially along a length of the elongated circular portion 108 such that the elongated circular portion 108 and the elongated platform portion 110 may collectively form a generally P-shaped cross-section 112 extending at least partially along the length of the connector body 102.

Upon providing the connector body 102 at block 902, a cable 104 may be mechanically coupled to the connector body 102 at block 904. For example, in certain embodiments, the connector body 102 may be mechanically coupled to the cable 104 via a strain relief device 106. In some instances, the strain relief device 106 may hold the cable 104 steady relative to the connector body 102 and/or compensate for tension applied to the cable 104 to prevent the cable 104 or a portion thereof from becoming decoupled from the connector body 102. Moreover, in certain embodiments, the cable 104 may include a coaxial wire 402. For example, the positive and negative wires of the coaxial wire 402 may be attached to the pair of connector terminals 118, respectively, via the connector terminal clamps 406 so as to facilitate an electrical connection between the spring loaded terminals 120 and the cable 104.

After mechanically coupling the cable 104 with the connector body 102 at block 904, a pair of connector magnets may be mechanically coupled to the connector body 102 at block 906. For example, the pair of connector magnets 116 may be positioned, at least partially, within the elongated platform portion 110, the elongated circular portion 108, or a combination thereof. In some instances, a surface of each of the pair of connector magnets 116 may be positioned flush with a surface of the elongated platform portion 110. In some examples, the pair of connector magnets 116 may be spaced apart along the connector body 102. In certain embodiments, the pair of connector magnets 116 may be configured such that the magnetic fields of the magnets in the pair are oriented opposite one another. As a result of this orientation, an attempted improper mating of the pair of connector terminals 118 with the pair of receptacle terminals 606 would result in a mutual repulsion between the connector magnets and the receptacle magnets.

At block 908 of method 900, a pair of connector terminals 118 may be mechanically mounted such that each of the pair of connector terminals 118 are between the pair of connector magnets 116. For example, the pair of connector terminals 118 may be positioned between the pair of connector magnets 116 along a surface of the elongated platform portion 110. In certain embodiments, the pair of connector terminals 118 may project from a surface of the connector body 102. For example, in one embodiment, the pair of connector terminals 118 may be positioned such that each of the pair of connector terminals 118 is between the pair of connector magnets 116 on the elongated platform portion 110 such that the pair of connector terminals 118 extend in a generally transverse direction from a surface of the elongated platform portion 110. In certain embodiments, each of the pair of connector terminals 118 may include a spring loaded terminal 120, such as a POGO® pin or the like, configured to apply a force to a corresponding receptacle terminal 606. In addition, in some embodiments, each of the pair of connector terminals 118 may include a shroud 122, comprised of a non-conductive material, positioned around each of the spring loaded terminals 120. In one embodiment, each of the pair of spring loaded terminals 120 may be at least partially recessed within the shroud 122.

At block 910 of method 900, a connector backing plate 408 may be magnetically coupled to the pair of connector magnets 116. When magnetically coupled, at least a portion of a magnetic field produced by the pair of connector magnets 116 impinges on the connector backing plate 408.

The connector backing plate 408 may be attached to the pair of connector magnets 116 to form a bridge between the pair of connector magnets 116. In certain embodiments, the connector backing plate 408 may be formed of a ferromagnetic material and may include a generally U-shaped configuration. In this manner, in some examples, the connector backing plate 408 may be configured to conduct a magnetic field of the pair of connector magnets 116. In some instances, a surface of the connector backing plate 408 in contact with each of the pair of connector magnets 116 may include a channel 502 configured to receive an adhesive for affixing each of the pair of connector magnets 116 to the connector backing plate 408.

Figure 10:
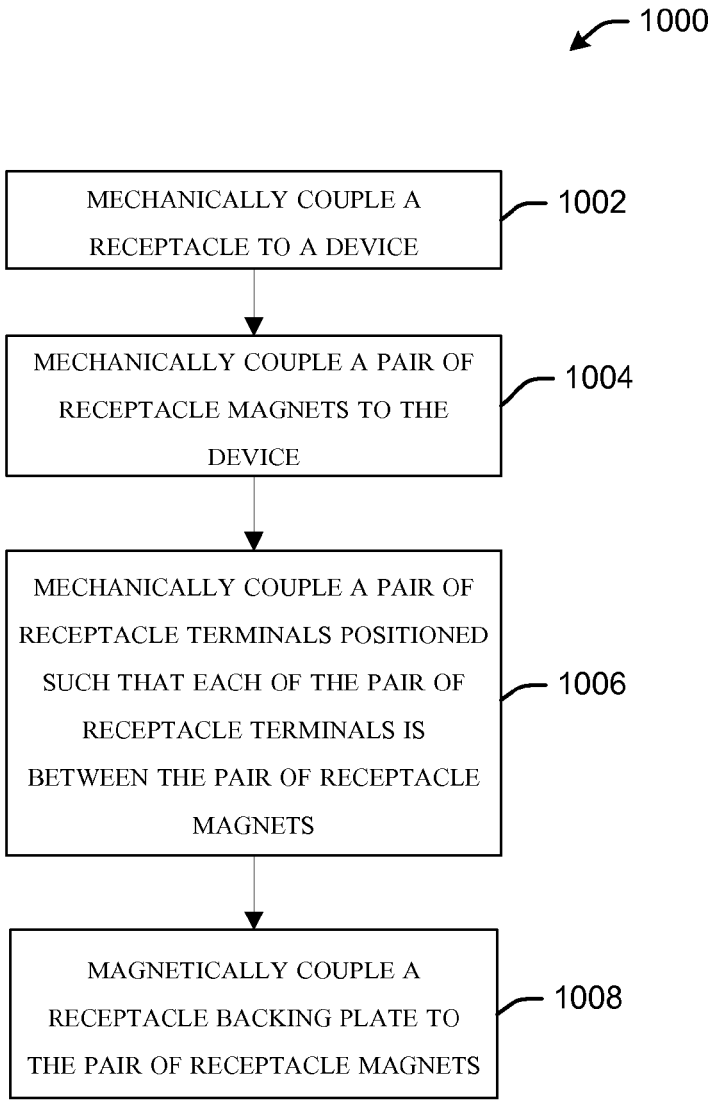
FIG. 10 is a flow diagram depicting an illustrative method for providing a receptacle in accordance with one or more embodiments of the disclosure.

FIG. 10 is a flow diagram depicting an illustrative method 1000 for providing the receptacle 600 in accordance with one or more embodiments of the disclosure. At block 1002 of method 1000, a receptacle 600 may be mechanically coupled to a user device 602. By way of example, the receptacle 600 may be part of any number of user devices 602, such as, but not limited to, tablets, smartphones, laptops, or the like. In certain embodiments, the receptacle 600 may be formed as part of the user device 602.

After mechanically coupling the receptacle 600 with a user device 602 at block 1002, a pair of receptacle magnets 604 may be mechanically coupled within the user device 602 at block 1004. For example, the pair of receptacle magnets 604 may be positioned, at least partially, within the user device 602. In some instances, a surface of each of the pair of receptacle magnets 604 may be positioned wholly within the user device 602 such that the pair of receptacle magnets 604 is not visible from outside of the user device 602. In addition, the pair of receptacle magnets 604 may be spaced apart at a distance about equal to the pair of corresponding connector magnets 116 of the connector 100. Moreover, each of the pair of receptacle magnets 604 may include a surface area about equal to a surface area of a corresponding connector magnet 116 of the connector 100. Accordingly, the pair of receptacle magnets 604 may be configured to magnetically couple with the pair of connector magnets 116 when brought within proximity of each other. In certain embodiments, however, the pair of receptacle magnets 604 may each include a predetermined polarization to prevent a user from improperly mating the pair of receptacle terminals 606 with the pair of connector terminals 118.

At block 1006 of method 1000, a pair of receptacle terminals 606 may be mechanically coupled to the receptacle such that each of the pair of the receptacle terminals 606 is between the pair of receptacle magnets 604. For example, the pair of receptacle terminals 606 may be positioned such that each of the pair of receptacle terminals 606 is between the pair of receptacle magnets 604 along a surface of the user device 602. In certain embodiments, each of the pair of receptacle terminals 606 may include a recess 608. In some examples, the recess 608 may be configured to mate with a corresponding shroud 122 of the connector terminals 118. Moreover, in other examples, each of the pair of receptacle terminals 606 may include a pin 610 positioned within the recess 608. In this manner, when the connector terminals 118 are mated with the receptacle terminals 606 such that the shrouds 122 of the connector terminals 118 are positioned within the recesses 608 of the receptacle terminals 606, the spring loaded terminals 120 of the connector terminals 118 may contact the pins 610 of the receptacle terminals 606 to create an electrical connection.

At block 1008 of method 1000, a receptacle backing plate 702 may be magnetically coupled to the pair of receptacle magnets 604. As described in this disclosure, magnetic coupling comprises placing at least a portion of a ferromagnetic material within a magnetic field produced by a magnet such that the ferromagnetic material conducts at least a portion of the magnetic field.

The receptacle backing plate 702 may be attached to the pair of receptacle magnets 604 to form a bridge between the pair of receptacle magnets 604. In certain embodiments, the receptacle backing plate 702 may be formed of a ferromagnetic material and may include a generally U-shaped configuration. In this manner, in certain embodiments, the receptacle backing plate 702 may be configured to conduct a magnetic field of the pair of receptacle magnets 604. In some instances, a surface of the receptacle backing plate 702 in contact with each of the pair of receptacle magnets 604 may include a channel configured to receive an adhesive for affixing each of the pair of receptacle magnets 604 to the receptacle backing plate 702.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described (e.g., manipulating a magnetic field, magnetic polarizations, etc.), embodiments of the disclosure may relate to numerous other device characteristics. Further, while embodiments of the disclosure have been described with respect to specific connector and receptacle configurations and positions, numerous other connector and receptacle configurations and positions are within the scope of this disclosure. Still further, while embodiments of the disclosure have been described with respect to specific types or configurations of connectors and receptacles, numerous other types and configurations of connectors and receptacles are within the scope of this disclosure.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments.

That which is claimed is:

1. A power cable system comprising:

a cable for connection to a power source;

a connector electrically connected and mechanically coupled to the cable, comprising:

a connector body mechanically coupled to the cable;

a pair of connector magnets spaced apart from each other by a first distance and mechanically coupled within the connector body;

a pair of connector terminals, each of the pair of connector terminals being positioned between the pair of connector magnets, the pair of connector terminals being electrically connected to the cable;

a connector backing plate magnetically coupled to the pair of connector magnets; and a receptacle electrically connected and mechanically coupled to a device, the receptacle comprising:

a pair of receptacle magnets positioned within the device and spaced apart from each other at a second distance about equal to the first distance, the pair of receptacle magnets having a first magnetic polarity that opposes a second magnetic polarity of the pair of connector magnets such that the pair of receptacle magnets is configured to magnetically couple with the pair of connector magnets when brought within proximity of each other;

a pair of receptacle terminals, each of the pair of receptacle terminals being positioned between the pair of receptacle magnets, the pair of receptacle terminals being configured to mate with the pair of connector terminals to form an electrical connection; and a receptacle backing plate attached to the pair of receptacle magnets.

2. The system of claim 1, wherein the connector backing plate and the receptacle backing plate are each formed of a respective ferromagnetic material that is configured to conduct a respective magnetic flux from each of at least one of the pair of connector magnets or at least one of the pair of receptacle magnets.

3. The system of claim 1, wherein the connector backing plate and the receptacle backing plate form a magnetically conductive path that conducts one or more magnetic fields between the pair of connector magnets and the pair of receptacle magnets.

4. A connector, comprising:

a connector body;

a pair of connector magnets mechanically coupled to the connector body at a first distance from each other;

a pair of connector terminals, each of the pair of connector terminals being positioned between the pair of connector magnets; and a ferromagnetic connector backing plate magnetically coupled to the pair of connector magnets and configured to conduct a respective magnetic field of each of the pair of connector magnets.

5. The connector of claim 4, wherein the connector body comprises:

an elongated circular portion extending along a length of the connector body; and an elongated platform portion positioned adjacent to the elongated circular portion and extending at least partially along a length of the elongated circular portion, wherein the elongated circular portion and the elongated platform portion collectively form a generally P-shape cross-section extending at least partially along the length of the connector body.

6. The connector of claim 4, wherein each connector terminal of the pair of connector terminals comprises a respective spring loaded terminal configured to apply a force to a corresponding receptacle terminal.

7. The connector of claim 4, wherein the connector backing plate is generally U-shaped.

8. The connector of claim 4, wherein the first distance between the pair of connector magnets is about equal to a second distance between a pair of receptacle magnets in a corresponding receptacle.

9. The connector of claim 4, wherein a respective face of each of the pair of connector magnets presented to a corresponding receptacle magnet of each of the pair of connector magnets comprises a respective surface area about equal to a respective surface area of a respective face of the corresponding receptacle magnet.

10. A receptacle, comprising:

a pair of receptacle magnets mechanically coupled to the receptacle at a first distance from each other;

a pair of receptacle terminals, each of the pair of receptacle terminals being positioned between the pair of receptacle magnets; and a receptacle backing plate magnetically coupled to each of the pair of receptacle magnets and configured to conduct magnetic fields of the pair of receptacle magnets.

11. The receptacle of claim 10, wherein each of the pair of receptacle terminals comprises:

a respective recess; and a respective pin positioned within the respective recess.

12. The receptacle of claim 10, further comprising a flex plate mechanically coupled to the pair of receptacle terminals and configured to supply a counteractive force when pressure is applied to one or both of the pair of receptacle terminals.

13. The receptacle of claim 10, wherein the pair of receptacle magnets is arranged such that a respective polarity of a first magnetic field from a first receptacle magnet of the pair of receptacle magnets is opposite to a respective polarity of a second magnetic field from a second receptacle magnet of the pair of receptacle magnets.

14. The receptacle of claim 10, wherein the receptacle backing plate is formed of a ferromagnetic material.

15. The receptacle of claim 10, wherein the receptacle backing plate is generally U-shaped.

16. The receptacle of claim 10, wherein the first distance is about equal to a second distance between a pair of corresponding connector magnets.

17. The receptacle of claim 10, wherein a respective face of each of the pair of receptacle magnets has a surface area about equal to a respective face of a corresponding connector magnet of the pair of connector magnets.

18. A power cable system comprising:

a connector, comprising:

a connector body;

at least two connector magnets mechanically coupled to the connector body;

at least one connector terminal mechanically coupled to the connector body; and a ferromagnetic connector backing plate magnetically coupled to the at least two connector magnets and configured to conduct one or more magnetic fields of the at least two connector magnets proximate to one or more corresponding receptacle magnets.

19. The system of claim 18, wherein the ferromagnetic connector backing plate is mechanically coupled to the at least two connector magnets.

20. The system of claim 18, further comprising:

a receptacle mechanically coupled and electrically connected to a device, the receptacle comprising:

at least two receptacle magnets mechanically coupled to the device, wherein each of the at least two receptacle magnets has a respective first magnetic polarity and is configured to mate with a respective corresponding one connector magnet having a respective second magnetic polarity of the at least two connector magnets;

at least one receptacle terminal mechanically coupled and electrically connected to the device and configured to mate with the at least one connector terminal to form an electrical connection; and a ferromagnetic receptacle backing plate magnetically coupled to the at least two receptacle magnets and configured to conduct a respective magnetic field of each of the at least two receptacle magnets proximate to the respective corresponding connector magnet of the at least two connector magnets.

* * * * *